US007325503B1

(12) United States Patent
Vaughn

(10) Patent No.: US 7,325,503 B1
(45) Date of Patent: Feb. 5, 2008

(54) WATERCRAFT LIFT

(75) Inventor: Michael D. Vaughn, Ketchum, OK (US)

(73) Assignee: Hydro Hoist International, Inc., Claremore, OK (US)

( * ) Notice: Subject to any disclaimer, the term of this patent is extended or adjusted under 35 U.S.C. 154(b) by 0 days.

(21) Appl. No.: 11/600,500

(22) Filed: Nov. 16, 2006

(51) Int. Cl.
*B63C 1/02* (2006.01)

(52) U.S. Cl. ..... 114/45

(58) Field of Classification Search ..... 114/45, 114/61.1, 123
See application file for complete search history.

(56) References Cited

U.S. PATENT DOCUMENTS 3,608,112 A * 9/1971 Irgens ..... 114/354
4,557,210 A * 12/1985 Gerwin ..... 114/61.23
4,875,426 A * 10/1989 Soga et al. ..... 114/123
4,993,350 A * 2/1991 Pepper ..... 114/292
5,016,551 A * 5/1991 Peck et al. ..... 114/45
5,394,814 A * 3/1995 Rutter et al. ..... 114/45
6,547,485 B2 * 4/2003 Elson ..... 405/3
6,752,096 B2 * 6/2004 Elson et al. ..... 114/45
6,755,142 B2 * 6/2004 Rice ..... 114/61.1

* cited by examiner

*Primary Examiner*—Stephen Avila
(74) *Attorney, Agent, or Firm*—Frank J. Catalano

(57) ABSTRACT

A lift for a watercraft has plastic reinforcing brackets which engage in pockets in the thin-walled plastic floatation tanks of the lift and which provide mounting flanges at the top surfaces of the floatation tanks for abutment with mounting pads which connect to the watercraft support frame. The brackets are engaged on the floatation tanks and the pads overlap and are bolted to the plastic brackets, so that the pads are locked against but not bolted to the floatation tanks. Thus, the integrity of the tanks is not compromised by assembly-associated openings through the tank walls. Furthermore, the bolts are above the tank waterlines so that no corrosive material is disposed below the waterlines.

17 Claims, 6 Drawing Sheets

WATERCRAFT LIFT

BACKGROUND OF THE INVENTION

This invention relates generally to watercraft lifts and more particularly concerns the structural components connecting the lift floatation tanks to the watercraft support frame.

In connecting lift floatation tanks to a watercraft support frame, the frame is fixed to the floatation tanks by bolts through flanges on the tanks, by metal belts tautly pulled around the cross-sections of the tanks or by use of welded assemblies of metal tubes and brackets with the tubes fitted into grooves in the sidewalls of the tanks. The bolts, surrounding belts and side mounted tube assemblies are continuously exposed to water. The integrity of the tank is eventually compromised by the reciprocating forces exerted at the bolt holes on the tank plastic while the lift is in use. The connections to the frame are typically located proximate the front and rear ends of the tanks. As a result, the weight of the watercraft is applied to the front and rear ends of the floatation tanks. The buoyancy force of the water, however, is applied to the entire length of the tanks. Therefore, the presence of the watercraft on the lift causes the hollow plastic tanks to bow downwardly at the ends, distorting the watercraft support frame. The use of side-of-tank tube assemblies may reduce the distortion to some extent, but the constant exposure of the metal tubes to the water far outweighs any such benefit. The deflection problem is most often resolved by the use of more plastic in the tank walls than would otherwise be necessary so as to strengthen the resistance of the tanks to deflection. Unfortunately, added plastic means a heavier and more expensive tank. In addition to these unique deficiencies, all of these known connecting systems are troublesome to install.

It is, therefore, an object of this invention to provide an improved watercraft lift. Another object of this invention is to provide a watercraft lift with a connecting assembly which does not use metal components below the waterline of a floatation tank. A further object of this invention is to provide a watercraft lift with a connecting assembly which does not compromise the structural integrity of the floatation tanks. Yet another object of this invention is to provide a watercraft lift with a connecting assembly which does not require the insertion of bolts through the floatation tank plastic. It is also an object of this invention to provide a watercraft lift with a connecting assembly which does not require the use of belts to girt the floatation tanks. Still another object of this invention is to provide a watercraft lift with a connecting assembly which does not require the engagement of welded tube and bracket assemblies in the side walls of the floatation tanks. An additional object of this invention is to provide a watercraft lift with a connecting assembly which does not place unnecessary stress on the floatation tank walls. Another object of this invention is to provide a watercraft lift with a connecting assembly which resists buoyancy-caused deflection of the floatation tanks. A further object of this invention is to provide a watercraft lift with a connecting assembly which enables use of thin-walled plastic floatation tanks. Yet another object of this invention is to provide a lightweight watercraft lift. And it is object of this invention to provide a watercraft lift with a connecting assembly which is easily installed.

SUMMARY OF THE INVENTION

In accordance with the invention, an improved connecting structure is provided for use in mounting a watercraft support frame on the floatation tanks of a watercraft lift.

A pair of pockets are spaced fore and aft in an upper longitudinal corner of the floatation tank A pair of pads have bottom surfaces sized and contoured to overlap their respective pockets and abut the top wall of the floatation tank. A pair of brackets are contoured for insertion into their respective pockets. Each bracket has a flange with a top surface contoured to abut the bottom surface of its respective pad when the bracket is disposed in its respective pocket. Upward and outward motion of each bracket relative to the floatation tank is limited by engagement of the bracket on the tank. The bracket flanges are fastened to their respective pads with the pads overlapping the pockets and abutting the floatation tank. Thus, the pads are secured in place on top of the tank without being fastened directly to the tank and the watercraft support structure can be mounted on the pads. The pockets are preferably sized for fore and aft tolerance of the brackets so as to compensate for the normal expansion and contraction of the components and forces exerted on the lifts in turbulent conditions without stressing the tank plastic.

In a preferred embodiment, a trough extends in the top of the floatation tank from approximately the fore to the aft pocket. The bottom of the trough slopes upwardly from the pockets to a crest. A reinforcing member extends from end to end in the trough. The pads abut the tops of the fore and aft ends of the reinforcing member and the crest abuts the bottom of the mid-portion of the reinforcing member when the pads are fastened to the brackets. This configuration of components resists buoyancy-induced bowing of the plastic tank. The reinforcing member may, for example, be a length of approximately 2" inch square steel tubing.

Preferably, the top surface of the floatation tank is flat in the area of the pocket. The pocket is in the side wall of the floatation tank and opens into the flat surface on the top of the floatation tank and the pad has a flat bottom surface for juxtaposition against the flat surface on top of the floatation tank. Preferably, the bracket is engaged to the tank by use of one or more downwardly depending lugs on the side wall of the floatation tank below the pocket. In its preferred embodiment, the bracket has a lower portion contoured for engagement on the lug and an upper portion contoured for insertion into the pocket with the top surface of the bracket in the plane of the flat surface on the top of the floatation tank when the bracket lower portion is engaged on its respective lug. One or more holes through the pad open into its respective pocket and aligns with one or more holes through the bracket flange when the pad is seated on the bracket. Nuts cooperable with bolts extending through the aligned holes complete the connection.

In its preferred embodiment, the bracket is S-shaped with a lower portion contoured for hinging on the lug and an upper portion contoured for insertion into the pocket. The downwardly depending lug is bifurcated and respective pad and bracket holes are aligned above respective lugs. The S-shaped bracket may have a vertical reinforcing rib dividing its lower portion into fore and aft segments and contoured for disposition between the spaced-apart lugs resulting from the bifurcation. The rib may also extend to the upper portion of the S-shaped bracket.

BRIEF DESCRIPTION OF THE DRAWINGS

Other objects and advantages of the invention will become apparent upon reading the following detailed description and upon reference to the drawings in which.

While the invention will be described in connection with preferred embodiments of its components, it will be understood that it is not intended to limit the invention to those embodiments or to the details of the construction or arrangement of parts illustrated in the accompanying drawings.

DETAILED DESCRIPTION

Figure 1:
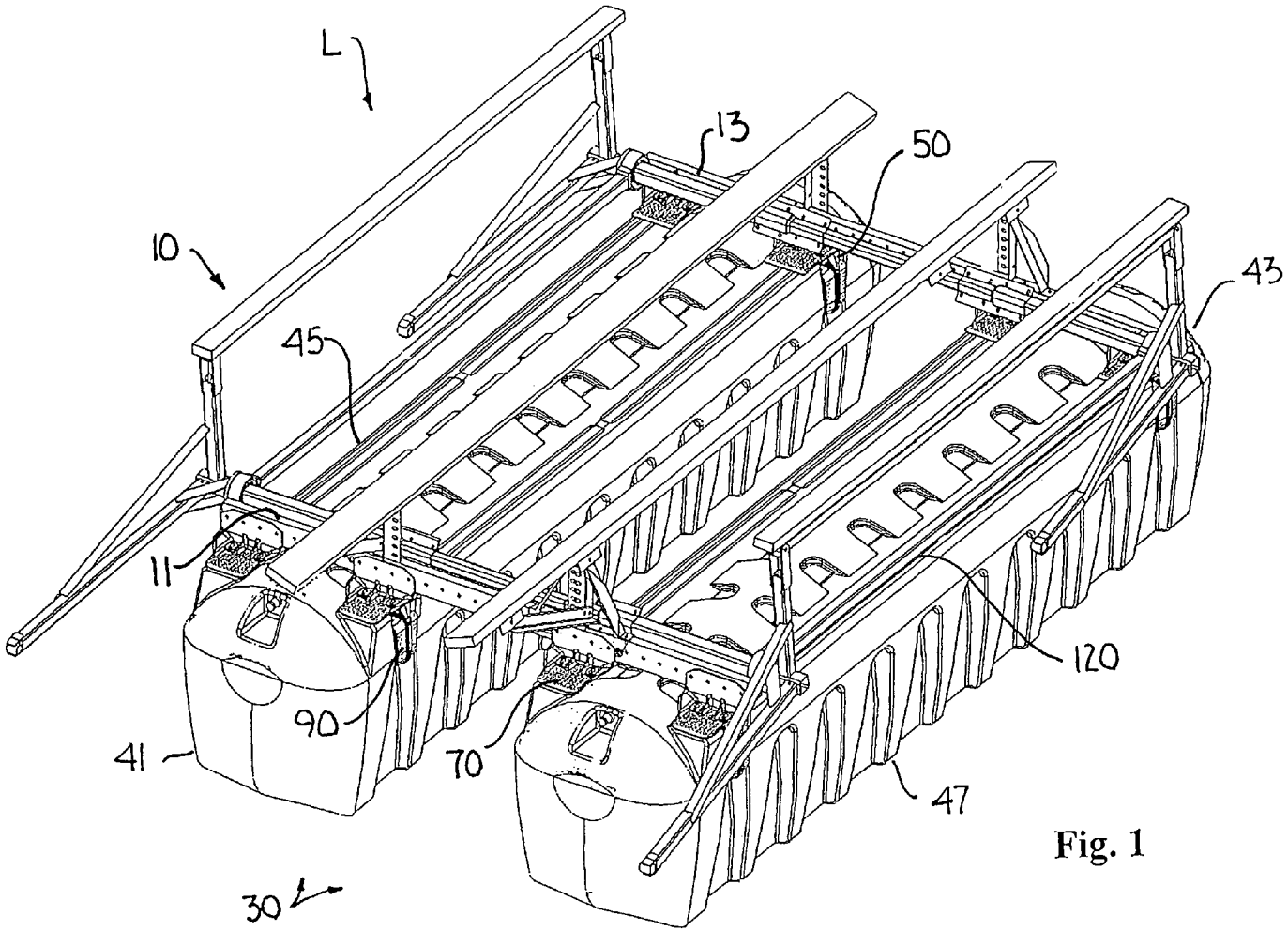
FIG. 1 is a perspective view of a watercraft lift in accordance with the invention.
Figure 2:
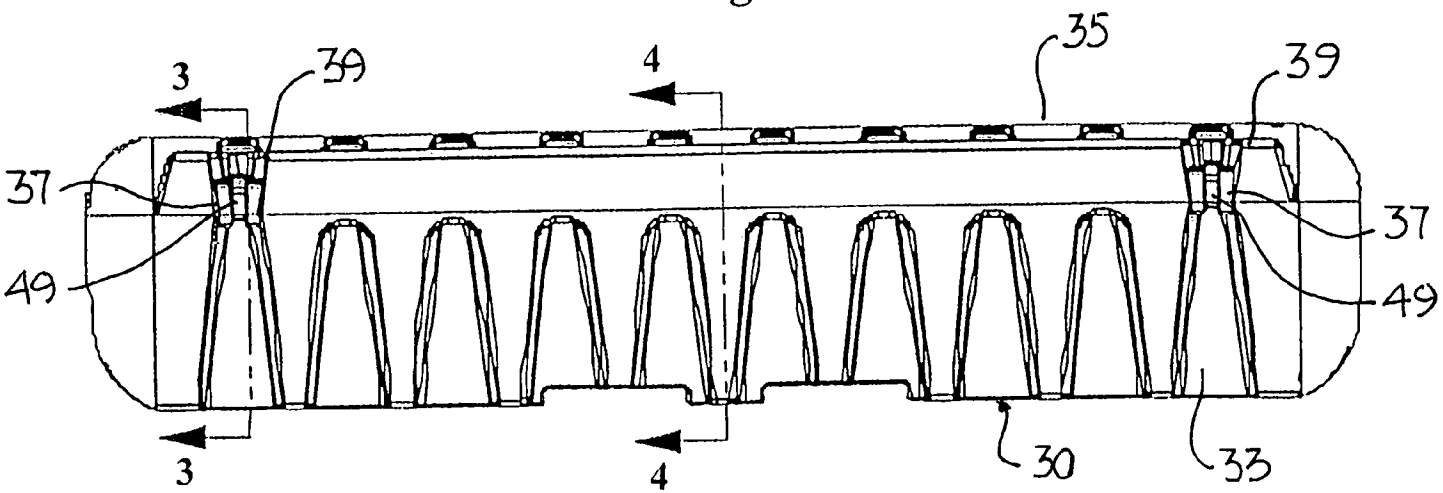
FIG. 2 is a side elevation view of a preferred embodiment of the floatation tanks of the lift of FIG. 1.
Figure 4:
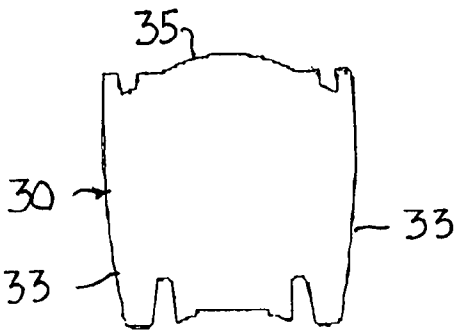
FIG. 4 is a cross-sectional view taken along the line 4-4 of FIG. 2.
Figure 3:
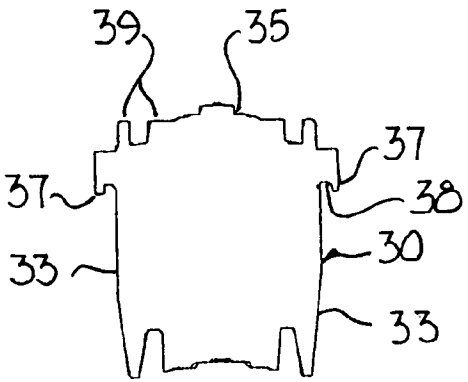
FIG. 3 is a cross-sectional view taken along the line 3-3 of FIG. 2.
Figure 6:
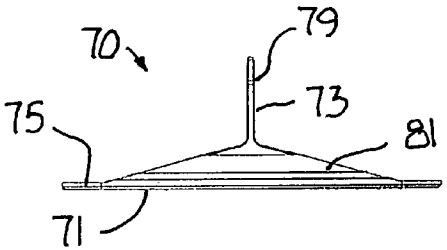
FIG. 6 is side elevation view of the pad of FIG. 5.
Figure 8:
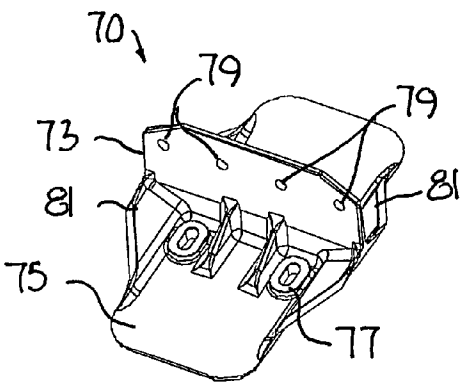
FIG. 8 is a perspective view of the pad of FIG. 5.
Figure 5:
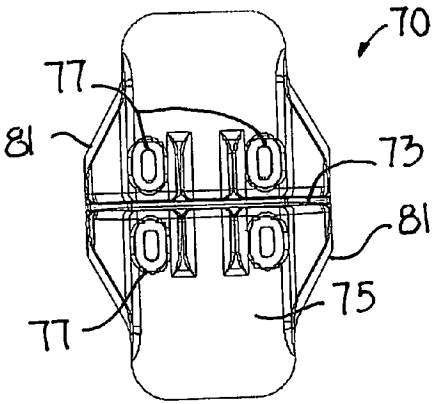
FIG. 5 is a top plan view of a preferred embodiment of the mounting pads of the lift of FIG. 1.
Figure 7:
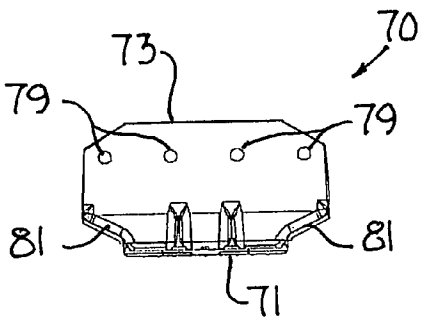
FIG. 7 is a front elevation view of the pad of FIG. 5.

Turning to FIG. 1, a watercraft support frame 10 is shown mounted on the floatation tanks 30 of a watercraft lift L. The tanks 30 are provided with pockets 50 which are spaced fore and aft and port and starboard in the upper longitudinal corners of the floatation tanks 30. The upper longitudinal corners, as herein referenced, are the upper lengthwise corners of the tanks 30 which are formed by the junction of the tank side walls 33 and top wall 35.

Pads 70, preferably of cast iron, overlap each of the pockets 50 and abut the top walls 35 of the floatation tanks 30. The pads 70 are seated on, but not directly connected to, the tanks 30. Rather, the pads 70 are connected directly to plastic brackets 90. Each of the brackets 90 has a flange 91 with a top surface 93 which is contoured to abut the bottom surface 71 of a pad 70 when the bracket 90 is disposed in a pocket 50. The plastic bracket 90 is engaged on a lug 37 on the plastic tank 30 and rotated on the lug 37 into the pocket 50 for abutment of the flange 91 with the bottom surface 71 of the pad 70. The bracket flange 91 is fastened to its pad 70 after the bracket 90 is engaged on the lug 37 and the pad 70 has been positioned to overlap the pocket 50 and abut the floatation tank 30. In this position the bracket 90 cannot be rotated on its lug 37. As a result, the pads 70 are secured in place on top of the tank 30 without being fastened directly to the tank 30 and the watercraft support frame 10 can be mounted to vertical flanges 73 on the pads.

The particular watercraft lift L illustrated in FIG. 1 consists of two floatation tanks 30 with eight pads 70. The cross members 11 and 13 secured to the pad flanges 73 form the base of the watercraft support frame 10, the frame 10 for the purposes of this disclosure being considered to consist of the cross members 11 and 13 and all of the components of the lift supported by the cross members 11 and 13. The actual configuration of the support frame 10 is, of course, determined by the type of watercraft to be supported.

As shown in FIGS. 1, 5-8 and 13-14, the pads 70 have a horizontal base 75 and a vertical flange 73. The pads 70 are symmetrical in relation to the flange 73 and in relation to a bisecting plane perpendicular to the flange 73. The pads 70 are preferably made of cast iron. The base 75 of the pad 70 has a flat bottom surface 71. Holes 77 are provided through the base 75, one in each of its four quadrants, and preferably oblong to facilitate their alignment with other lift components during assembly. A plurality of holes 79 is also provided through the vertical flange 73 to facilitate connection of the watercraft support frame 10 to the pad 70. Additional reinforcing structure 81 may also be used to strengthen the pad 70.

Figure 13:
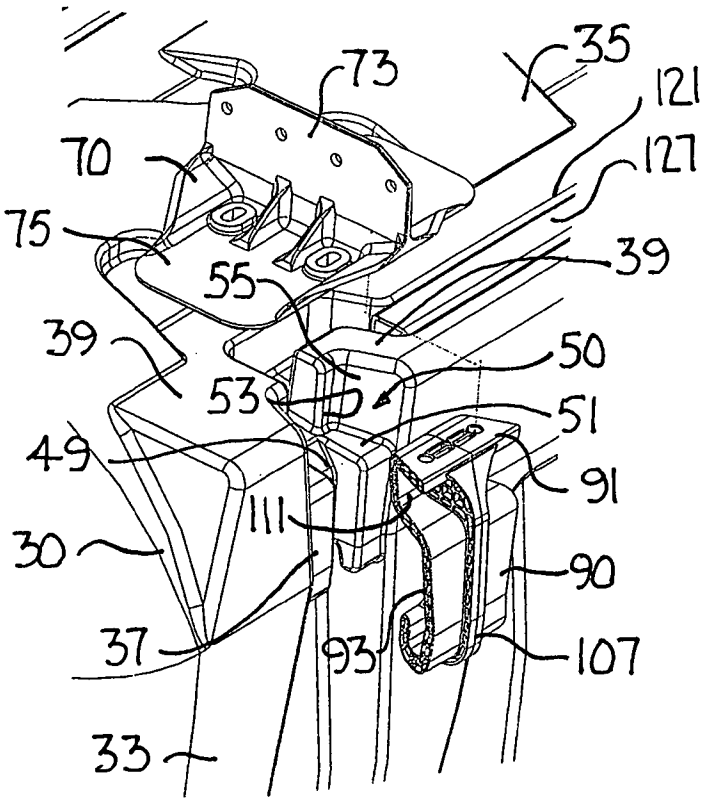
FIG. 13 is a perspective assembly view of the floatation tank, pads and brackets of FIGS. 2, 5 and 9.

Looking at FIGS. 1-4 and 13-16, the tanks 30 are provided with flat surfaces 39 against which the flat-bottomed bases 75 of the pads 70 can be abutted. As seen in FIG. 1, in which eight pads 70 are employed, eight flat surfaces 39 are provided on the two tanks 30. The flat surfaces 39 are located proximate the fore 41 and aft 43 and port 45 and starboard 47 portion of the top walls 35 of the tanks 30. As best seen in FIG. 13, each flat surface 39 has an associated pocket 50 in the side wall 33 of the tank 30, the pocket 50 opening through and bordered on three sides by the flat surface 39. Each of the pockets 50 also has a downwardly depending lug 37 below it. As best seen in FIG. 13, the lug 37 is bifurcated, providing a gap 49 between the forward and aft portions of the lug 37.

Looking at FIG. 8, 9-14, the bracket 90, preferably S-shaped in cross-section as shown, has a lower portion 93 contoured to slide upwardly over and hinge on the lug 37 depending from the tank 30 below the pocket 50 and an upper portion 95 contoured for insertion into the pocket 50 as the bracket 90 is hinged on the lug 37. The upper portion 95 of the bracket 90 has a flange 91 with a top surface 97 which is contoured to abut the bottom surface 71 of the pad 70 when the pad 70 is disposed across the pocket 50. As the bracket 90 is rotated on the lug 37 to insert the upper portion 95 of the bracket 90 into the pocket 50, the lower surface 99 of the horizontal midportion 101 of the bracket 90 contacts the bottom surface 51 of the pocket 50 and the lower end 103 of the S-shaped cross-section abuts the bottom 38 of the horizontal portion of the depending lug 37, firmly seating the bracket 90 in the pocket 50. Furthermore, as the bracket 90 rotates, the upper flat face 97 of the flange 91 reaches its maximum elevation in which the bracket flange top face 97 is in the plane of the top face 39 of the floatation tank 30 when the bracket 90 is fully inserted into the pocket 50.

Figure 9:
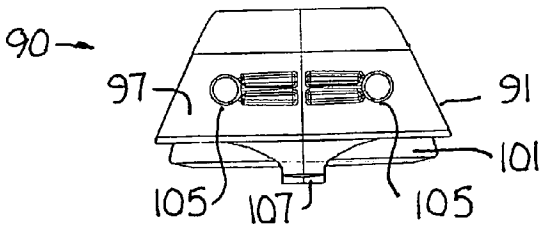
FIG. 9 is a top plan view of a preferred embodiment of the mounting brackets of the lift of FIG. 1.
Figure 10:
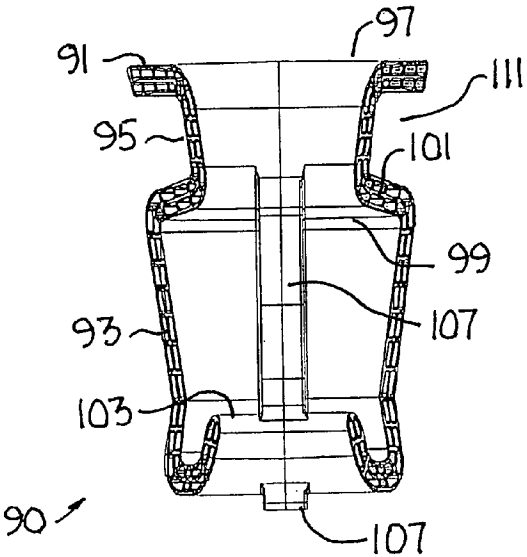
FIG. 10 is a side elevation view of the bracket of FIG. 9.
Figure 12:
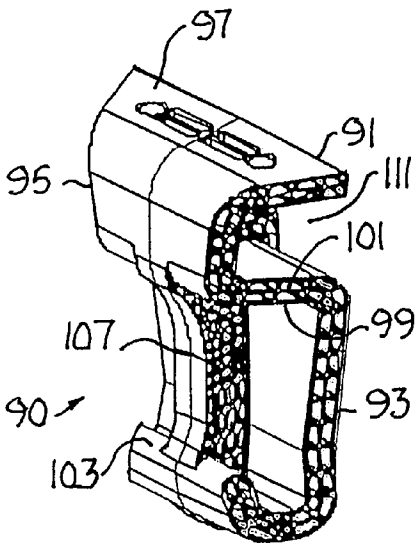
FIG. 12 is a perspective view of the bracket of FIG. 9.
Figure 11:
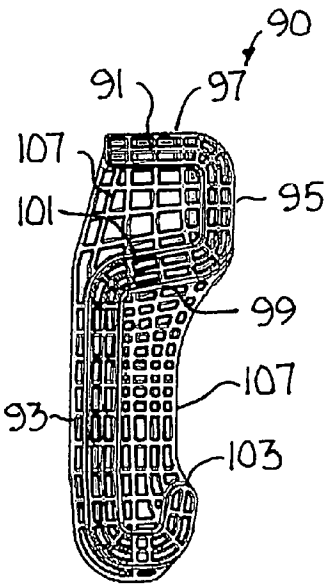
FIG. 11 is a rear elevation view of the bracket of FIG. 9.
Figure 14:
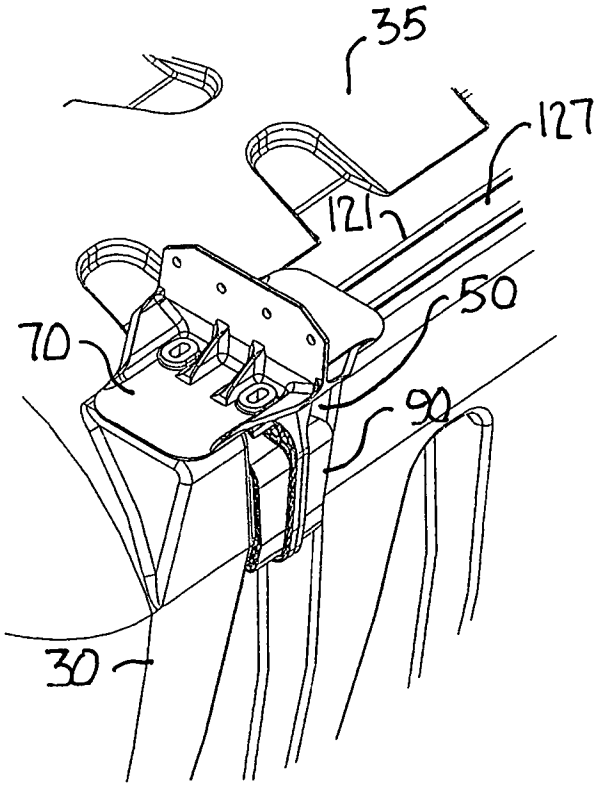
FIG. 14 is a perspective view of the assembled components of FIG. 13.

As best seen in FIG. 9, the bracket flange 91 is provided with a pair of holes 105 which are oriented to align with two of the holes 77 in the base 75 of the pad 70. The bracket 90 is also provided with a vertical reinforcing rib 107 which, as shown, divides lower portion 93 of the bracket 90 into fore and aft segments. As best seen in FIGS. 13 and 14, the contour of the rib 107 is such that it can be inserted into the gap 49 in the bifurcated lug 37 with the respective pad and bracket holes 77 and 105 aligned above the forks of the lug 37. The rib 107 may also extend as shown to divide the upper portion 95 of the S-shaped bracket 90 into fore and aft segments. When the bracket 90 has been engaged on the lug 37 and rotated into the pocket 50, the flat bottom surface 71 of the base 75 of the pad 70 can be rested on the tank 30 in a position to overlap the pocket 50 and abut the flat upper surfaces 39 and 97 of the floatation tank 30 and the bracket flange 91. The outboard holes 77 on the base 75 of the pad 70 can then be aligned with the holes 105 through the flange 91 of the bracket 90. Bolts 109 inserted through the aligned holes 77 and 105 of the pad base 75 and bracket flange 91 will extend into the outwardly accessible area 111 of the bracket 90 under the flange 91 where nuts 113 can be threaded to the bolts 111 to secure the pad 70 against the flange 91 and also against the flat surface 39 of the tank 30. Since the bracket 90 cannot be removed from the pocket 50 without rotational motion of the bracket 90 about the lug 37, and since the bottom face 71 of the pad 70 abuts the top flat surface 39 of the tank 30 at the highest position of the bracket 90, the bracket 90 cannot be raised or rotated and therefore cannot be disengaged from the tank 30. This is further assured after connection of the watercraft support frame cross-members 11 and 13 to the pads 70 which, once installed on the pads 70, prevents the pads 70 and therefore the brackets 90 connected thereto from rotating on the lugs 37. Preferably, the fore-to-aft dimensions of the bracket 90 are less than the fore-to-aft dimensions of the pocket 50 so that some fore-to-aft motion of the bracket 90 within the pocket 50 is available to compensate for the normal expansion and contraction of the lift components and for forces exerted on the lift L during turbulent weather conditions.

Figure 15:
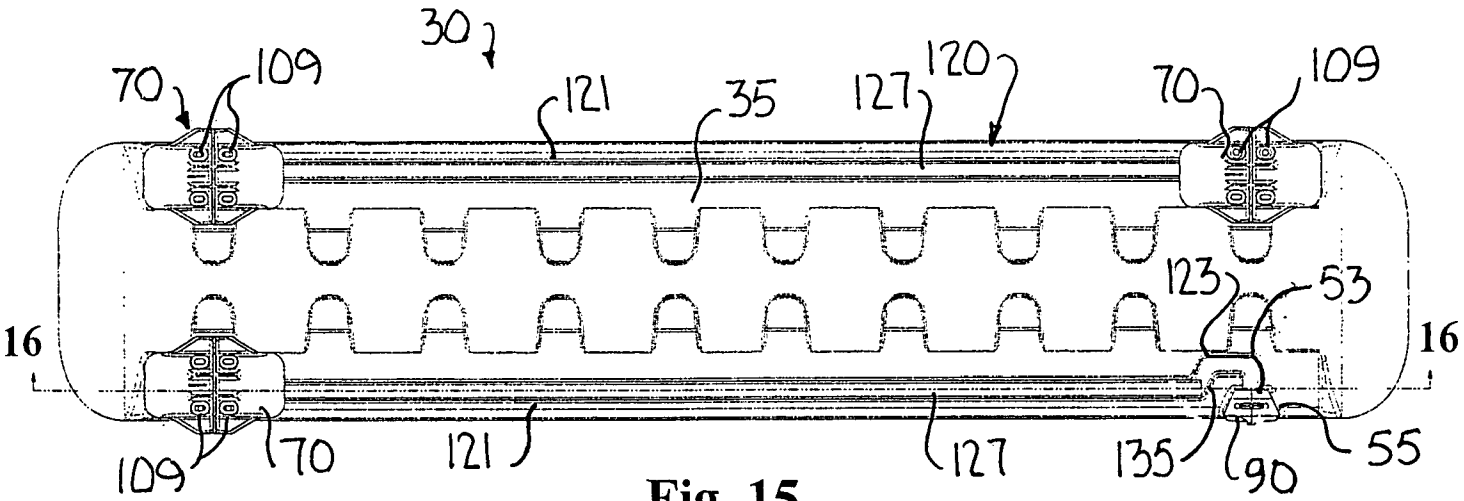
FIG. 15 is a top plan view of the floatation tank of FIG. 2 with a reinforcing member secured thereon by the pads of FIG. 5.
Figure 16:
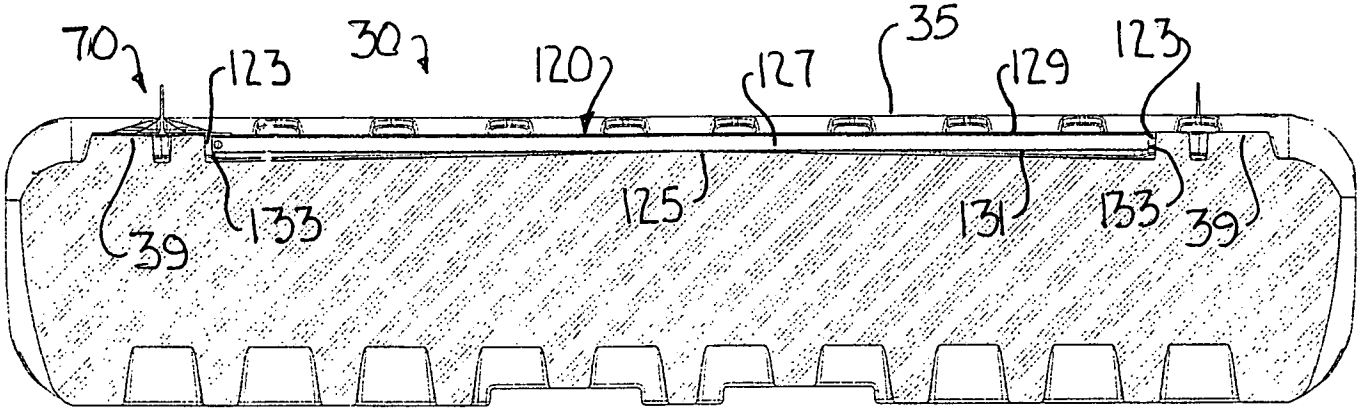
FIG. 16 is a cross-sectional view taken along the line 16-16 of FIG. 15.

Turning to FIGS. 15 and 16, a reinforcing structure 120 is illustrated. A trough 121 extends in the top wall 35 of the floatation tank 30 from approximately each fore pocket 50 to each aft pocket 50. As shown, each tank 30 has a port side and starboard side trough 121. The trough 121 is sloped upwardly from each of its ends 123 toward a crest 125 at a mid-portion of the length of the trough 121. In assembling the lift L, a reinforcing member 127, such as a steel tube of square cross-section as shown, is seated in each trough 121 before its pads 70 are mounted on the tank 30. The reinforcing members 127 may, for example, be lengths of approximately 2" inch square steel tubing. As best seen in FIG. 16, the cross-section of the tube 127 is such that, when the bottom surfaces 71 of the pads 70 are butted against the top surfaces 129 of the ends 123 of the tube 127, the bottom surface 131 of the tube 127 is butted against the crest 125. Thus, the reinforcing tube 121 counteracts the buoyancy-induced deflection forces on the tank 30. The tube 127 is located at the top of the tank 30, above the tank water line, so that the tube 127 is not constantly exposed to water. If water should collect in the trough 121, the slopes of the trough 121 allow the water to drain towards the pockets 50. As best seen in FIG. 15, the end portions 123 of the troughs 121 are redirected to enter into the inboard sides 53 of their pockets 50 rather than through the side walls 55 of the pockets 50. Consequently, the ends 133 of the reinforcing tube 127 can be positioned in contact with opposed transverse walls 135 of the trough 121, preventing fore and aft motion of the tube 127 in the trough 121 without extending the tube 127 into the pocket 50.

The brackets 90 are engaged on, but not fastened to, the tank 30. Therefore, the brackets 90 can be made of substantially sturdier plastic while the tanks 30 can be of relatively thin-walled plastic. Thus, the overall weight of the lift L is reduced. The cast iron pads 70 are secured by steel, but the steel is entirely above the lift water line and not immersed in water. No welding need be involved in the assembly. No mounting holes need be provided in the tank plastic. No stresses are applied to the plastic walls of the tanks 30 by components fixed directly to the tanks 30. The use of the pads 70 facilitates the incorporation of the anti-buoyancy-deflection reinforcing structure 120, though the reinforcing structure 120 need not necessarily be incorporated into the lift L. Furthermore, the reinforcing system 120 herein described may be incorporated into lifts which do not incorporate the tank-to-watercraft support structure herein described.

Thus, there has been provided, in accordance with the invention, a watercraft lift that fully satisfies the objects, aims and advantages set forth above. While the invention has been described in conjunction with specific embodiments of the invention and its component parts, many alternatives, modifications and variations will be apparent to those skilled in the art in light of the foregoing description. Accordingly, it is intended to embrace all such alternatives, modifications and variations as fall within the spirit of the appended claims.

What is claimed is:

1. For connecting a floatation tank to a supporting frame of a watercraft lift, an improvement comprising:

a pocket in an upper longitudinal corner of the floatation tank;

a pad having a bottom surface sized and contoured for overlapping said pocket and abutting a top wall of the floatation tank;

a bracket contoured for insertion into said pocket and having a flange with a top surface contoured to abut said bottom surface of said pad when said bracket is disposed in said pocket;

means for limiting upward and outward motion of said bracket relative to the floatation tank; and means for fastening said bracket flange to said pad with said pad overlapping said pocket and abutting the floatation tank.

2. An improvement according to claim 1, said pocket sized for fore and aft tolerance of said bracket therein.

3. For connecting a floatation tank to a supporting frame of a watercraft lift, an improvement comprising:

a flat surface on a top of the floatation tank;

a pocket in a side wall of the floatation tank, said pocket having an opening in said flat surface on the top of the floatation tank;

a downwardly depending lug on the side wall of the floatation tank below said pocket;

a pad having a flat bottom surface for juxtaposition against said flat surface on top of the floatation tank;

a bracket having a lower portion contoured for engagement on said lug and an upper portion contoured for insertion into said pocket with a top surface of said bracket in a plane of said flat surface of the top of the floatation tank when said bracket lower portion is engaged on said lug; and means for fastening said bracket upper portion to said pad with said pad overlapping said pocket and abutting the floatation tank.

4. An improvement according to claim 3 further comprising:

at least one hole through said pad opening into said pocket in the floatation tank;

at least one hole through said upper portion of said bracket for alignment with said at least one hole through said pad when said pad is seated on said plane; and said fastening means comprising a nut co-operable with a bolt extending through said holes.

5. For connecting a floatation tank to a supporting frame of a watercraft lift, an improvement comprising:

a flat surface on a top of the floatation tank;

a pocket in a side wall of the floatation tank, said pocket having an opening in said flat surface on the top of the floatation tank;

a downwardly depending lug on the side wall of the floatation tank below said pocket;

a pad having a flat bottom surface for juxtaposition against said flat surface on top of the floatation tank, said pad having a pair of holes therethrough opening into said pocket; and an S-shaped bracket having a lower portion contoured for hinging on said lug and an upper portion contoured for insertion into said pocket with a top surface of said bracket in a plane of said flat surface of the top of the floatation tank when said bracket lower portion is hinged on said lug, said upper portion having a pair of holes therethrough for alignment with said pair of holes of said pad when said pad is seated on said plane.

6. An improvement according to claim 5, said fastening means comprising a pair of nuts co-operable with respective ones of a pair of bolts extending through respective ones of said holes.

7. An improvement according to claim 5 further comprising another downwardly depending lug on said side wall of said floatation tank below said pocket, said downwardly depending lugs being spaced-apart and respective ones of said pad and bracket holes being aligned above a respective one of said lugs.

8. An improvement according to claim 7, said fastening means comprising a pair of nuts co-operable with respective ones of a pair of bolts extending through respective ones of said holes.

9. An improvement according to claim 7, said S-shaped bracket having a vertical reinforcing rib dividing said lower portion into fore and aft segments, said rib being contoured for disposition between said spaced-apart lugs.

10. An improvement according to claim 9, said rib further dividing said upper portion of said S-shaped bracket into fore and aft segments.

11. For connecting a floatation tank to a supporting frame of a watercraft lift, an improvement comprising:

a pair of pockets spaced fore and aft in an upper longitudinal corner of the floatation tank;

a pair of pads having bottom surfaces sized and contoured for overlapping respective ones of said pockets and abutting a top wall of the floatation tank;

a pair of brackets contoured for insertion into respective ones of said pockets, each said bracket having a flange with a top surface contoured to abut said bottom surface of its respective said pad when said bracket is disposed in its respective said pocket;

means for limiting upward and outward motion of each said brackets relative to the floatation tank; and means for fastening each said bracket flange to its respective said pad with said pad overlapping said pocket and abutting the floatation tank.

12. An improvement according to claim 11 further comprising a trough extending in the top of the floatation tank from the fore to the aft pocket.

13. An improvement according to claim 12, a bottom of said trough sloping upwardly from said pockets to a crest.

14. An improvement according to claim 13 further comprising a reinforcing member extending from end to end in said trough.

15. An improvement according to claim 14, said pads abutting fore and aft ends of said reinforcing member and said crest abutting a mid-portion of said reinforcing member when said pads are fastened to said brackets.

16. An improvement according to claim 15, said trough being inboard of said pockets relative to the floatation tank and said fore and aft ends of said reinforcing member abutting respective fore and aft ends of said trough.

17. An improvement according to claim 14, said reinforcing member being a length of approximately 2" inch square steel tubing.

* * * * *